US005626228A

United States Patent [19]

Wiemann et al.

[11] Patent Number: 5,626,228

[45] Date of Patent: May 6, 1997

[54] THIN-WALLED CAN HAVING PLURALITY OF SUPPORTING FEET WITH TWO SUPPORT FEATURES

[75] Inventors: David J. Wiemann, O'Fallon; David H. Henkelmann, Imperial, both of Mo.

[73] Assignee: Anheuser-Busch Incorporated, St. Louis, Mo.

[21] Appl. No.: 640,461

[22] Filed: May 1, 1996

[51] Int. Cl.[6] ..... B65D 8/00

[52] U.S. Cl. ..... 206/511; 220/606

[58] Field of Search ..... 220/606, 608, 220/624; 206/511

[56] References Cited

U.S. PATENT DOCUMENTS

| | | | |
|---|---|---|---|
| D. 254,957 | 5/1980 | Campbell et al. | 220/606 X |
| D. 257,463 | 10/1980 | Campbell et al. | 220/606 X |
| D. 269,066 | 5/1983 | Gaunt | 220/606 X |
| 4,264,017 | 4/1981 | Karas et al. | 220/606 X |
| 4,646,930 | 3/1987 | Karas et al. | 220/606 |
| 4,685,582 | 8/1987 | Pulciani et al. | 220/606 |
| 4,732,292 | 3/1988 | Supik | 220/606 |
| 4,834,256 | 5/1989 | McMillin | 220/606 |

*Primary Examiner*—Steven M. Pollard
*Attorney, Agent, or Firm*—Sidley & Austin

[57] ABSTRACT

A metal container for holding fluids is provided having a bottom wall including a externally convex dome portion and a plurality of supporting feet formed therein. The supporting feet are circumferentially spaced apart from each other and projected generally downward beyond the dome portion. Each supporting foot has formed thereon stand features and stacking features. The stand features are radially spaced from the longitudinal axis of the container and disposed at downwardmost locations on the feet to alone support the container in an upright position on a flat horizontal surface when the container is not internally pressurized. The stacking features are disposed adjacent to the stand features and define, in cross-sectional elevation view, axial stacking surfaces and radial stacking surfaces. The axial stacking surfaces are axially positioned in relation to stand features and the radial stacking surfaces are radially positioned in relation to the longitudinal axis so as to interfit with an upper seamed edge of an adjacent below container to alone provide for stacking engagement when the container is not internally pressurized. Since the bottom wall does not rely on any large-radius externally concave mechanical features to resist internal pressurization, a thinner gauge metal can be used to satisfy design parameters and can achieve cost and metal reduction savings. The profile of the bottom wall also results in very small values for profile deformation and changes in can dimensions over a wide range of internal pressures.

21 Claims, 8 Drawing Sheets

THIN-WALLED CAN HAVING PLURALITY OF SUPPORTING FEET WITH TWO SUPPORT FEATURES

TECHNICAL FIELD OF THE INVENTION

The present invention relates to thin-walled metal cans having a cylindrical side wall and a bottom wall integral therewith. In one aspect, it relates to a can having a bottom wall with a plurality of discrete support features.

BACKGROUND OF THE INVENTION

Thin-walled metallic cans, such as those used for packaging beer, soft drinks and other beverages, are currently produced in quantities exceeding ninety billion cans per year in the United States. Because of this extremely high volume of production, even the smallest savings in the metal from these cans are made can result in enormous cost savings. It is therefore meaningful to reduce the starting gauge of the metal used to make such cans by as little as one one-tenthousandth of an inch (0.0001"). Current technologies allow the production of 12 ounce cans having side wall thicknesses as low as 0.005" without loss of integrity because, structurally, the sealed can is a cylindrical "pressure vessel." That is, it relies for part of its strength on the internal force exerted by the liquid and gas contained within the can. In contrast, the bottom of conventional cans continues to be manufactured with a thickness of about 0.010" to about 0.011" in order to withstand the axial loads of up to 200 pounds imposed on unsealed cans during manufacturing and filling operations and also to resist unwanted deformation of the sealed cans from axial loads caused by shipping or stacking or from internal pressures, which may range from 40 psig up to over 100 psig.

Most applications for metallic beverage cans have additional requirements for stand stability, stacking stability, mobility and resistance to shipping and handling loads and vibrations.

Stand stability relates to a can's ability to rest in an upright position on a flat horizontal surface without wobbling or tipping. Stand stability is important during the automated processing of both empty and filled cans as well as for consumer convenience and acceptance. The features on the can bottom which support an upright can on a flat horizontal surface are known as "stand features." The diameter of an imaginary circle centered on the longitudinal axis of the can and passing through the stand features represents a parameter called the "stand diameter." Stand stability is increased by providing stand features which are disposed radially outwardly as far as possible from the can's longitudinal axis, i.e., by increasing the stand diameter.

Stacking stability relates to a can's ability to rest stably in an upright position on the top of a below adjacent can. Stacking stability includes resistance to tipping or wobbling by the can as well as resistance to lateral movement between the stacked cans. Stacking stability is typically achieved by providing features in the bottom profile of the upper can which interfit with features in the lid profile of the lower can and by providing sufficient clearance between the bottom of the upper can and the lid and tab of the lower can.

Mobility relates to a can's ability to transit automated handling and conveying equipment without tipping, catching, jamming or otherwise impeding operations. For example, cans must be able to transit the "dead plates" in a conveyor system without tipping over or catching. Mobility is of particular concern for empty cans because their light weight reduces their resistance to tipping, however mobility is necessary for both empty and filled cans. It is known that mobility is affected by both stand diameter and by the profile of the stand features, i.e., increasing stand diameter typically increases mobility and increasing the radius of the stand features typically increases mobility.

Resistance to shipping and handling loads and vibrations relates to a can's ability to withstand the axial loads imposedby having additional cans stacked above during shipping and by the vibrations associated with transportation in trucks and other distribution and delivery vehicles. Vibrations and axial loads combine to produce flexures in the can walls which may ultimately lead to fatigue cracking of the metal. The interior lid panel and interior bottom wall of the can are the most susceptible to such flexure-induced cracking. It is therefore preferable that cans in stacking engagement have no contact between the interior bottom wall of the above-adjacent can and the interior lid panel or pull tab of the below-adjacent can.

To meet the structural requirements for can bottoms, conventional industry practice is to form the can bottom into an externally concave, i.e., upwardly domed shape that will not interfere with stand stability if it bulges outward somewhat under internal pressure and will not contact the interior lid panel or lifting tab of another can when in stacked engagement. However, such upwardly domed bottoms must be formed of relatively thick material to resist excessive deformation. In addition, upwardly domed bottom walls reduce the internal volume of the can and may experience a failure mode known as "dome reversal" if the internal pressure becomes too high, thus rendering the can unstable and thus unsalable.

U.S. Pat. Nos. 3,904,069, 4,412,627 and 4,431,112 contain discussions of upwardly domed can bottoms and the phenomena of dome reversal caused by internal pressure. Upwardly domed can bottoms will not be discussed further herein, however, since the present invention does not employ an upwardly domed can bottom and is intended to be an alternative to that approach.

An alternative to can designs having a conventional upwardly domed bottom wall is found in the "displaceable" bottom wall designs of U.S. Pat. Nos. 3,979,009, 4,037,752 and 5,421,480. Displaceable bottom wall designs have first stand features which provide stand stability when the can is unpressurized, however, as the internal pressure in the can exceeds a predetermined level, the bottom wall is displaced downwardly to provide second stand features which replace the first features in providing stand stability. Such displaceable bottom wall designs experience a change in the overall height of the can when the bottom wall is displaced outwardly. Displaceable can bottoms will not be discussed further herein, however, since the present invention does not employ a displaceable bottom wall design and is intended to be an alternative to that approach.

It is an object of the present invention to reduce the thickness of the metal in a can bottom wall without affecting the structural integrity of the can. Another object of the invention is to reduce the thickness of the can bottom wall to less than about 0.010" while still enabling the unsealed can to withstand an axial force of about 200 pounds without permanent deformation. A further object of the current invention is to provide a can having an externally convex, i.e., downwardly domed bottom wall which minimizes the "growth", or increase in overall height of the sealed can when it is subjected to a range of internal pressures. A further object of the current invention is to provide a can which exhibits stand stability, stacking stability and mobility even when subjected to a range of internal pressures. It is yet another object of the current invention to provide a can having a downwardly domed bottom wall which, when placed in stacking engagement with a below adjacent can, does not contact the interior lid panel or pull-tab of the can below when subjected to a range of internal pressures and vibrations. It is still another object of the current invention to provide a can with a bottom wall formed with primarily outwardly convex mechanical features. It is still another object of the current invention to provide a can with a bottom wall which does not undergo a change in mechanical modes when the sealed can is subjected to a range of internal pressures.

SUMMARY OF THE INVENTION

For purposes of clarity and consistency some of the terms used in the specification and the claims hereof will now be defined. "Can" and "container" are used interchangeably. "Lid" means a closure which is, or is intended to be, affixed to a can body containing a product. Directional terms such as "up," "down," "upper," "lower," "side," "horizontal," and "vertical" refer to cans, can bodies, and can ends as though they were resting upright on a horizontal surface. It will be understood, however, that the can components may be, and probably will be, in different orientations as they are being manufactured and used. "Axis" and "axial" refer to the longitudinal axis of the can body, and "radial" and "radially" relate to that axis. "Profile" means the profile of a can end or a can body as viewed in a cross-section taken along its longitudinal (vertical) axis. "Radius of curvature" refers to a curve in the profile of the can body. "Internal pressure" refers to any pressure differential existing between the pressure in the interior cavity of the can and the ambient pressure in the region of the can's exterior.

A metal container according to the present invention comprises a generally cylindrical side wall and a bottom wall formed integrally with the side wall from a single sheet of metal. The side wall has a longitudinal axis and extends axially upward from the bottom wall to define an interior cavity and an open end of the container adapted to be closed with a lid. The bottom wall includes an externally convex dome portion with a plurality of supporting feet formed therein. The feet are typically circumferentially spaced apart from each other and project downward beyond the dome portion when the can is subjected to internal pressures less than about 70 psig. Each foot has formed thereon stand features and stacking features. The stand features are radially spaced from the longitudinal axis of the container and positioned at the downwardmost locations on the feet to alone provide stand stability, i.e., to support the container in an upright position on a flat horizontal surface, in the absence of internal pressure. The stacking features are positioned adjacent to the stand features and define, in cross-sectional elevation view, externally concave recesses having axial stacking surfaces and radial stacking surfaces. The axial stacking surfaces are axially positioned in relation to the stand features and the radial stacking surfaces are radially positioned in relation to the longitudinal axis of the container to interfit with an upper seamed edge of a similar container directly below such that the stacking features provide stacking stability, i.e., they support the upper container in both vertical and horizontal engagement with the lower container so that the cans will be "stackable." In the absence of internal pressure, the stacking features alone will provide stacking support for the upper container, i.e., there will be no contact between the domed bottom wall of the upper container and the interior lid panel or pull-tab of the lower container, nor between the stand features of the upper container and the interior lid panel of the lower container.

When a thin walled container is subjected to internal pressurization, some dimensional growth normally occurs. However, the bottom wall of the container of this invention is downwardly domed, so internal pressurization of the container causes the bottom wall to be in tension so as to resist operationally significant deformation as the result of such pressurization. In a preferred embodiment of the present invention, the bottom wall is formed without any large-radius externally concave mechanical features which would be susceptible to significant deformation as a result of internal pressurization within the container. The unique bottom wall construction of this invention allows the use of thinner gauge metal for the production of such cans, thus achieving corresponding metal and cost reduction savings. In another preferred embodiment of the current invention, the maximum thickness of the bottom wall is less than about 0.010".

The metal container of the current invention utilizes a bottom wall having an externally convex, i.e., downwardly domed, profile. In one preferred embodiment of the invention, wherein the side wall has a side wall radius R1 with a value V1, the domed portion of the bottom wall will be defined, in cross-sectional elevation view through a region of the domed portion between circumferentially adjacent feet, by a radius of curvature R2 with a value V2 in the range of about 1.6 to about 2.2 times the value V1. In a more preferred embodiment of the current invention, the domed portion is defined, in cross-sectional elevation view through a region of the domed portion between circumferentially adjacent feet, by a radius of curvature R2 with a value V2 in the range of about 1.72 to about 1.88 times the value V1.

For the purposes of transportation, storage and display, it is important that a filled, finished can be stackable, i.e., that the bottom surfaces of one can are precisely dimensioned to cooperate with the lid surfaces of a similar can directly below so as to provide resistance to tipping or lateral movement and to provide clearance between the bottom of the upper can and the lid and tab of the lower can.

The container of the current invention has a plurality of supporting feet formed in the bottom wall with each foot having formed thereon stand features and stacking features. These supporting feet are preferably formed at circumferentially spaced locations, for example, 6 feet centered at 60° from each other or 5 feet centered at 72° from each other.

In one aspect of the current invention, the stand features are disposed radially inward relative to the stacking features. In this aspect, the stacking features are located on radially outward oriented faces of the feet, and the stand features of an upper container fit radially inside the rim of a lower container when the two containers are in stacking engagement. In a preferred embodiment of this aspect, each supporting foot is generally polyhedral in shape having exterior faces including a substantially flat trapezoidal outer face, a substantially flat inner face, a generally "S" shaped lower face joining the inner and outer faces, and two generally trapezoidal lateral faces each having a substantially flat central region surrounded by locally curved edges which are continuously joined to the bottom wall and free edges of the other faces to form the supporting feet.

In another aspect of the current invention, the stand features are disposed radially outward relative to the stacking features. In this aspect, the stacking features are located on radially inward oriented faces of the feet and the stand features of an upper container fit radially outside the rim of a lower container when the two containers are in stacking engagement.

Yet another embodiment of the current invention provides a container for holding fluids comprising a generally cylindrical side wall, a bottom wall having a plurality of supporting feet and a lid. The side wall is integrally formed with the bottom wall, has a longitudinal axis, and extends substantially upward from the bottom wall to define both an interior cavity and an open end of the container, which is adapted to be closed with a lid. After a fluid is introduced into the interior cavity, a lid is seamed onto the open end of the container forming a rim having a pressure tight seal which isolates the interior cavity. The bottom wall includes an externally convex, i.e., downwardly domed, dome portion and a plurality of supporting feet formed therein which are circumferentially spaced apart from each other and project generally downward beyond the dome portion when the container is internally pressurized to less than about 70 psig. Each supporting foot has formed thereon stand features and stacking features similar in structure to the stand and stacking features on the embodiments previously described. The stand features alone support the can upright on a flat horizontal surface and the stacking features alone support the can in stacking relationship with a similar below adjacent container when the container has an internal pressure less than about 70 psig.

When the container of the current invention is in an upright position the container has an overall height H measured axially from the highest portion of the rim on the lid to the lowest portion on the stand features. In a preferred embodiment, the difference between a value for the overall height H for the container when the interior cavity is internally pressurized to 0 psig and the overall height H for the container when the interior cavity is internally pressurized to 70 psig is within the range of about 0" to about 0.04".

The container of the current invention is preferably formed by utilizing existing drawing and ironing equipment in conjunction with one or more bottom forming operations. The supporting feet may be completely formed on the bottom wall during the bottom forming operations to prevent failure in the metal sheet which might occur if such features were added onto the punch or on the cup when the punch passes through the drawing and ironing rings.

Still other objects and advantages of the present invention will become readily apparent to those skilled in this art from the following detailed description, wherein several preferred embodiments of this invention are shown and described. As will be realized, the invention is capable of other and different embodiments, and its several details are capable of modifications in various obvious respects, all without departing from the invention. Accordingly, drawings and descriptions are to be regarded as illustrative in nature, and not as restrictive.

DETAILED DESCRIPTION

Figure 2:
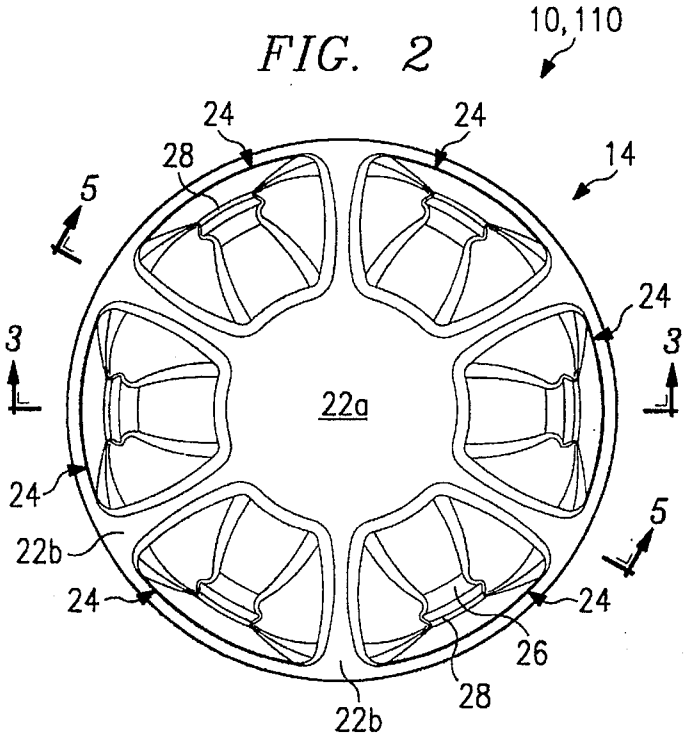
FIG. 2 is a bottom plan view showing the bottom wall and supporting feet of the container of FIG. 1 or FIG. 10.
Figure 1:
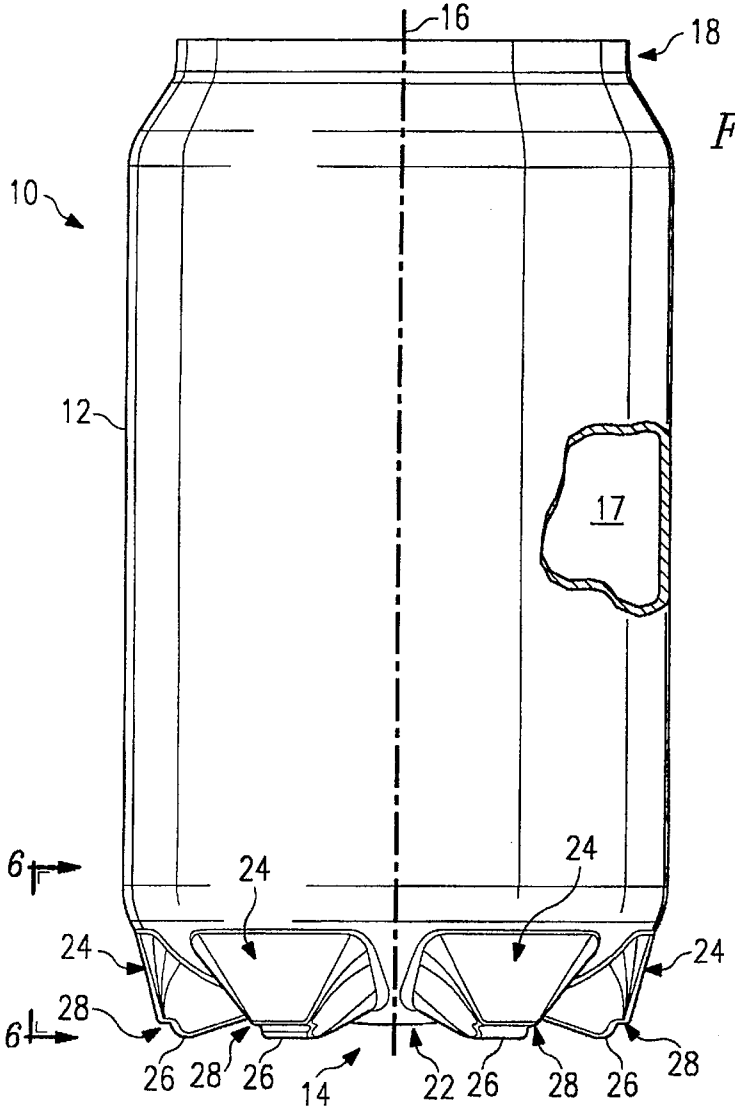
FIG. 1 is an elevation view of a container constructed in accordance with one embodiment of the present invention with a partial cut-away to show the interior cavity; the wall thickness of the container shown in the cut-away portion is greatly exaggerated for purposes of illustration.

Referring generally to FIGS. 1–8, a metal container 10 in accordance with one embodiment of the current invention is shown. Such a container could be used as one component in what is generally termed a "two piece" can. Referring specifically to FIG. 1, container 10 has a generally cylindrical side wall 12 and a bottom wall 14 formed integrally with side wall 12. Side wall 12 has a longitudinal axis 16 and extends substantially axially upward from the bottom wall 14 to define an interior cavity 17 and an open end of the container 18 which is adapted to be closed with a lid (not shown) which may be seamed onto open end 18 after the introduction of a fluid (not shown) into interior cavity 17. It should be noted that the thickness of side wall 12 shown in the cut-away portion of FIG. 1 has been greatly exaggerated for purposes of illustration. While side wall 12 is most commonly constructed in the form of a circular cylinder which is symmetrical about longitudinal axis 16, those skilled in the art will appreciate that other side wall configurations are within the scope of this invention including an embossed cylinder, a cylinder comprising straight or helical spiral flutes, or a cylinder comprising a plurality of rectangular, triangular, or diamond-shaped facets. Bottom wall 14 includes an externally convex, i.e., downwardly domed, dome portion 22 and a plurality of supporting feet 24 formed therein. Referring now to FIGS. 1 and 2, supporting feet 24 are positioned along an imaginary circle centered on longitudinal axis 16, are spaced apart from each other and project generally downward beyond dome portion 22. The embodiment shown in FIGS. 1 and 2 has six supporting feet 24 circumferentially spaced 60° apart from each other, however, those skilled in the art will readily appreciate that differing numbers of supporting feet 24 and different spacing of feet 24 on container bottom 14 are within the scope of the current invention.

Referring now to FIG. 2 it can be seen that the externally convex dome portion of bottom wall 14 comprises both a central portion 22*a* located radially inward from supporting feet 24, and outer portions 22*b*, which extend between circumferentially adjacent supporting feet 24. One of the functions of outer portions 22*b* of the domed bottom, formed by the spaced-apart disposition of supporting feet 24 on bottom wall 14, is as follows: when the container is internally pressurized, a downward force is exerted on central portion 22*a* of the domed bottom. This downward force must be resisted to prevent the undesirable downward displacement of central portion 22*a*. In the current invention, outer portions 22*b* supply the necessary resisting force to prevent excessive downward displacement of central portion 22*a* by acting as structural members primarily loaded in tension between central portion 22*a* and side wall 12. Since they are loaded in tension, outer portions 22*b* can be much thinner and smaller in area than structural members loaded in bending. This use of tension members represented by outer portions 22*b* thus allows can bottom wall 14 to be produced from thinner material.

Figure 3:
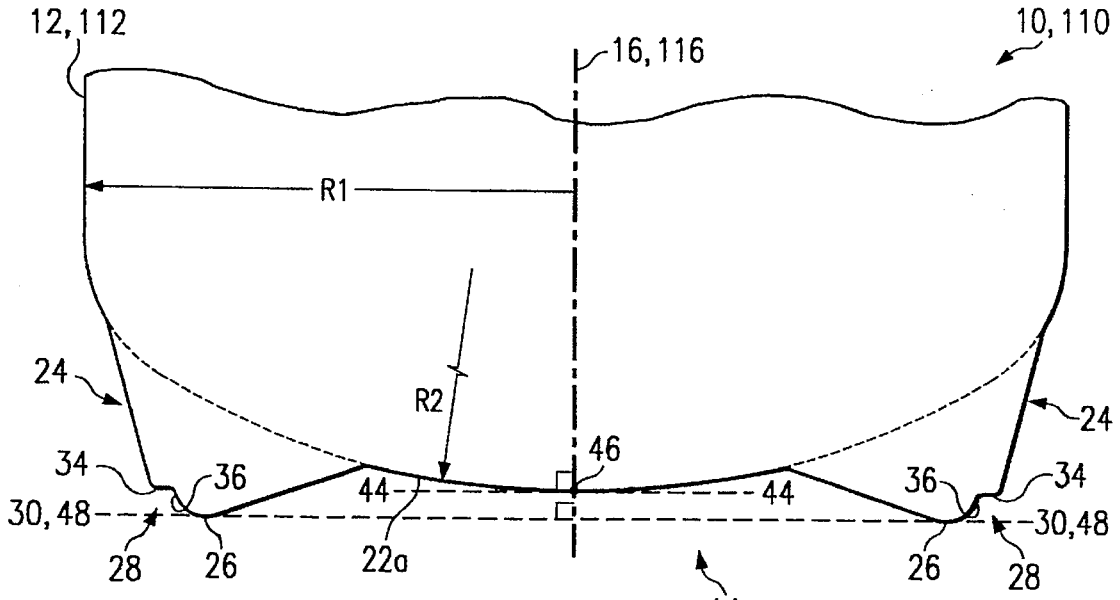
FIG. 3 is a partial cross-sectional elevation view of the lower portion of the container taken along the line 3—3 of FIG. 2.
Figure 4:
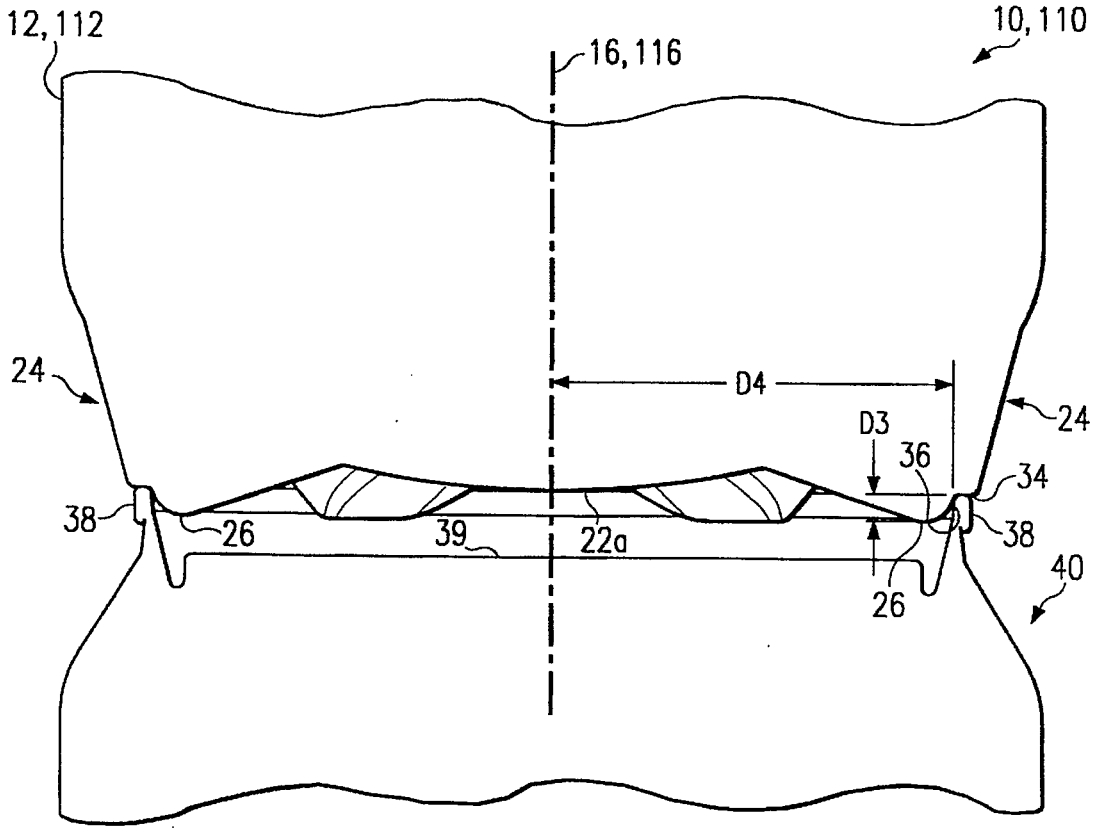
FIG. 4 is another partial cross-sectional elevation view, similar to FIG. 3, but depicting the bottom wall of the container of FIG. 2 in stacked relationship with an adjacent below container.
Figure 5:
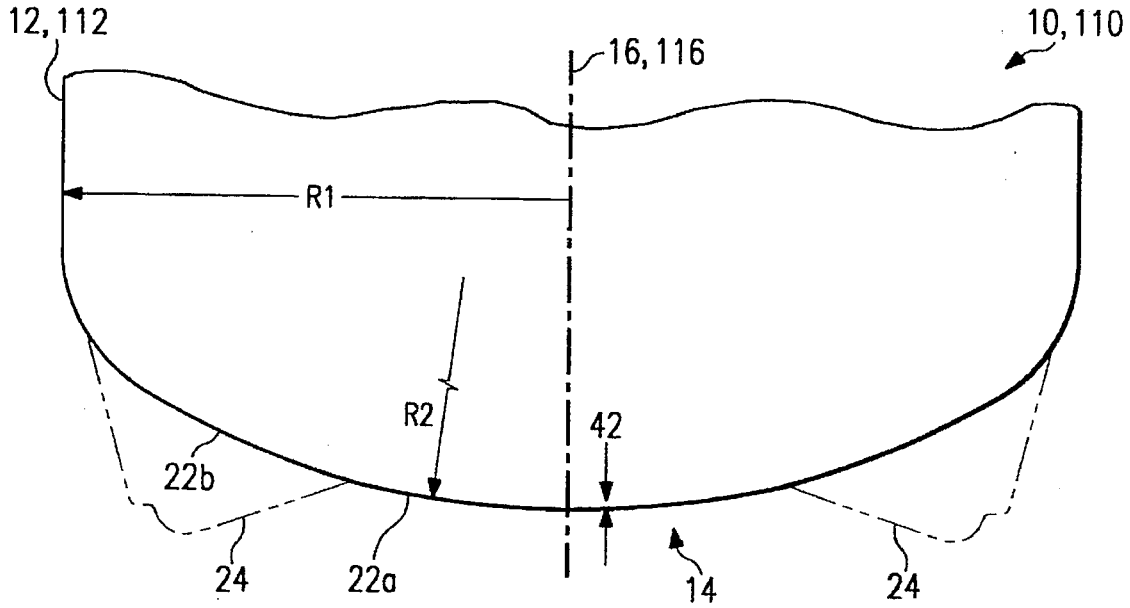
FIG. 5 is a partial cross-sectional elevation view of the lower portion of the container taken along line 5—5 of FIG. 2.

FIG. 3 is a partial cross-sectional view of the lower portion of container 10 viewed along the line 3—3 of FIG. 2, which passes through dome portion 22 and a pair of radially opposite supporting feet 24. FIG. 5 shows another partial cross-sectional view of the lower portion of container 10 taken along line 5—5 of FIG. 2, which passes through domed portion 22 between circumferentially adjacent supporting feet 24 (the approximate location of the feet is shown in phantom). Referring now to FIG. 3, it can be seen that each supporting foot 24 has formed thereon stand features 26 and stacking features 28. Stand features 26 are radially spaced from longitudinal axis 16 and disposed at downwardmost locations on feet 24 such that stand features 26 alone support container 10 in an upright position on a flat horizontal surface 30 (shown in phantom) when the container is not internally pressurized. In the embodiment shown in FIG. 3, stand features 26 are disposed radially inward relative to stacking features 28. Stacking features 28 are disposed at radially outward oriented locations on feet 24 adjacent to stand features 26 and defined, in cross-section elevation view, by an axial stacking surface 34 and a lateral stacking surface 36. Referring now to FIG. 4, it can be seen that axial stacking surfaces 34 are positioned axially upward a distance D3 in relation to stand features 26 and lateral stacking surfaces 36 are positioned radially outward a distance D4 in relation to longitudinal axis 16 so as to interfit with an upper seamed rim 38 of an adjacent below container 40 to support container 10 in stacking engagement. It can be seen that neither the central portion 22*a* of the domed bottom nor the stand features 26 of the container come in contact with the interior lid panel 39 of the below adjacent container and that clearance exists for the lifting tab (not shown) which lies on lid panel 39.

Referring once again to FIGS. 3 and 5, certain additional features of domed portion 22 can now be described. In the embodiment illustrated in FIGS. 3 and 5, container 10 has a domed portion 22 of bottom wall 14 which is defined, in cross-sectional elevation view, by a relatively constant radius of curvature R2 for both the central portion 22*a*, which lies between radially opposite support feet 24, and for outer portion 22*b*, which lies between circumferentially adjacent support feet 24. Use of a relatively constant radius of curvature in the bottom profile provides a container with superior resistance to deformation when the container is internally pressurized.

Referring still to FIG. 3, in a preferred embodiment, side wall 12 has a side wall radius R1 extending radially from longitudinal axis 16 to side wall 12 and having a value V1, and domed portion 22 has a radius of curvature R2 with a value V2 in the range of about 1.6 to about 2.2 times the value V1 of side wall radius R1. In a more preferred embodiment, domed portion 22 has a radius of curvature R2 with a value V2 in the range of about 1.72 to about 1.88 times the value V1 of side wall radius R1.

In yet another embodiment of the current invention, dome portion 22 is defined, in cross-sectional elevation view, by a radius of curvature R2 with a value in the range of about 2.08" to about 2.86". In a still more preferred embodiment, dome portion 22 is defined in cross-sectional elevation view by a radius of curvature R2 with a value in the range of about 2.24" to about 2.44".

Because container 10 has a bottom wall 14 including an externally convex domed portion 22 having radius of curvature R2 relatively large in relation to side wall radius R1 and applying not only to the central portion 22*a* of bottom wall 14 but also to outer portions 22*b* extending between adjacent supporting feet 24, container 10 has favorable structural characteristics, especially when it is internally pressurized. Since bottom wall 14 is shaped in the form of an externally convex pressure vessel, such bottom is able to resist significant unwanted deformation or growth when container 10 is internally pressurized. This ability to resist deformation when pressurized is greatly sought after for commercial beverage containers. The advantageous structural shape of container 10 allows the container to be constructed form a thinner sheet of metal stock, a goal which is much sought after in the metal container industry.

Container 10 may be made of a relatively thin sheet of metal such as aluminum or steel. In one embodiment of the invention, container 10 may be a 12 oz. beverage container having a main body diameter of about 2.6" made from one piece of sheet aluminum having an initial thickness of from about 0.010" to about 0.011". However, those skilled in the art will appreciate that the inventive concepts may be employed in containers made from various metals or metal-composites and with various other dimensions. The sheet material may be conventionally formed using drawing and ironing equipment and possibly end forming equipment as is well known to one of ordinary skill in the can manufacturing art. The manufacturing process will result in a container having side wall 12 with a thickness in the range of 0.0030" to 0.0045" over most of its height, although side wall 12 may have a thickness between 0.0070" to 0.0075" in the region of open end 18 in order to withstand the mechanical loads imposed during necking and sealing operations.

Referring now to FIG. 5, in a preferred embodiment of the current invention, the maximum thickness 42 of the bottom wall 14 is less than about 0.010". Those skilled in the art will readily appreciate that if conventional drawing and ironing manufacturing methods are used, then the maximum thickness 42 of bottom wall 14 is likely to be present in central portion 22*a* of the domed portion 22. However, yet-to-be-developed manufacturing methods may allow the positioning of metal thicknesses at more optimized locations such that maximum thickness 42 may be in a position other than that shown in FIG. 5 without departing from the scope of the current invention.

A necessary characteristic for a metal beverage container is that it must have stand stability, i.e., it must rest in a stable upright position when placed on a flat horizontal surface and must remain stable even when subjected to a wide range of internal pressurization. Referring now to FIG. 3, the lower portion of a container 10 according to the current invention is shown resting in an upright position on flat horizontal surface 30 (shown in phantom). Can 10 is supported on flat horizontal surface 30 only by stand features 26 located at the downwardmost portion of each supporting foot 24. In a metal container 10 constructed according to the current invention, a first plane 44 formed perpendicular to longitudinal axis 16 and tangent to a downwardmost point 46 on dome portion 22 of bottom wall 14 is located axially above a second plane 48 formed perpendicular to longitudinal axis 16 and passing through stand features 26 when the container is internally pressurized to less than about 70 psig. Such a structure provides that stand features 26 will always be the downwardmost points on can bottom 14 so as to alone provide stand stability for container 10 under normal storage and use conditions, i.e., internal pressure less than 70 psig.

Figure 6:
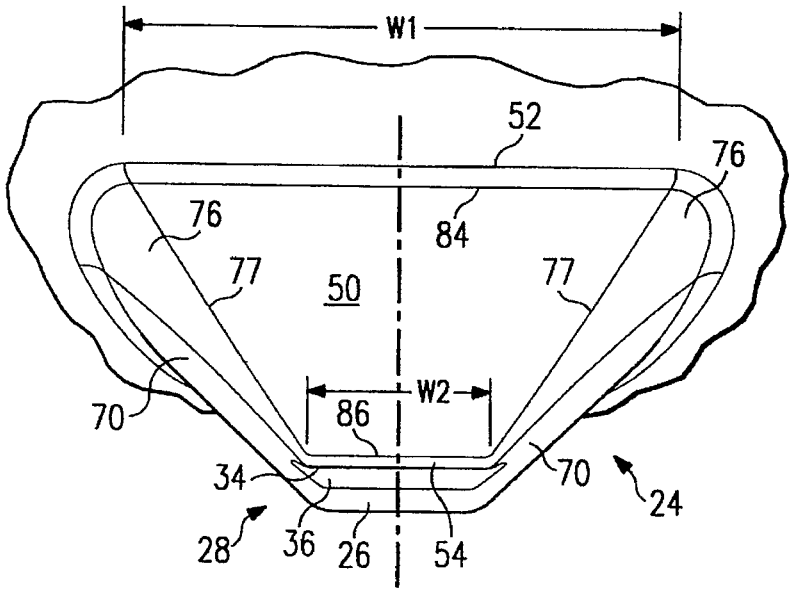
FIG. 6 is a detailed elevation view of one of the supporting feet viewed radially inward from line 6—6 of FIG. 1.
Figure 7:
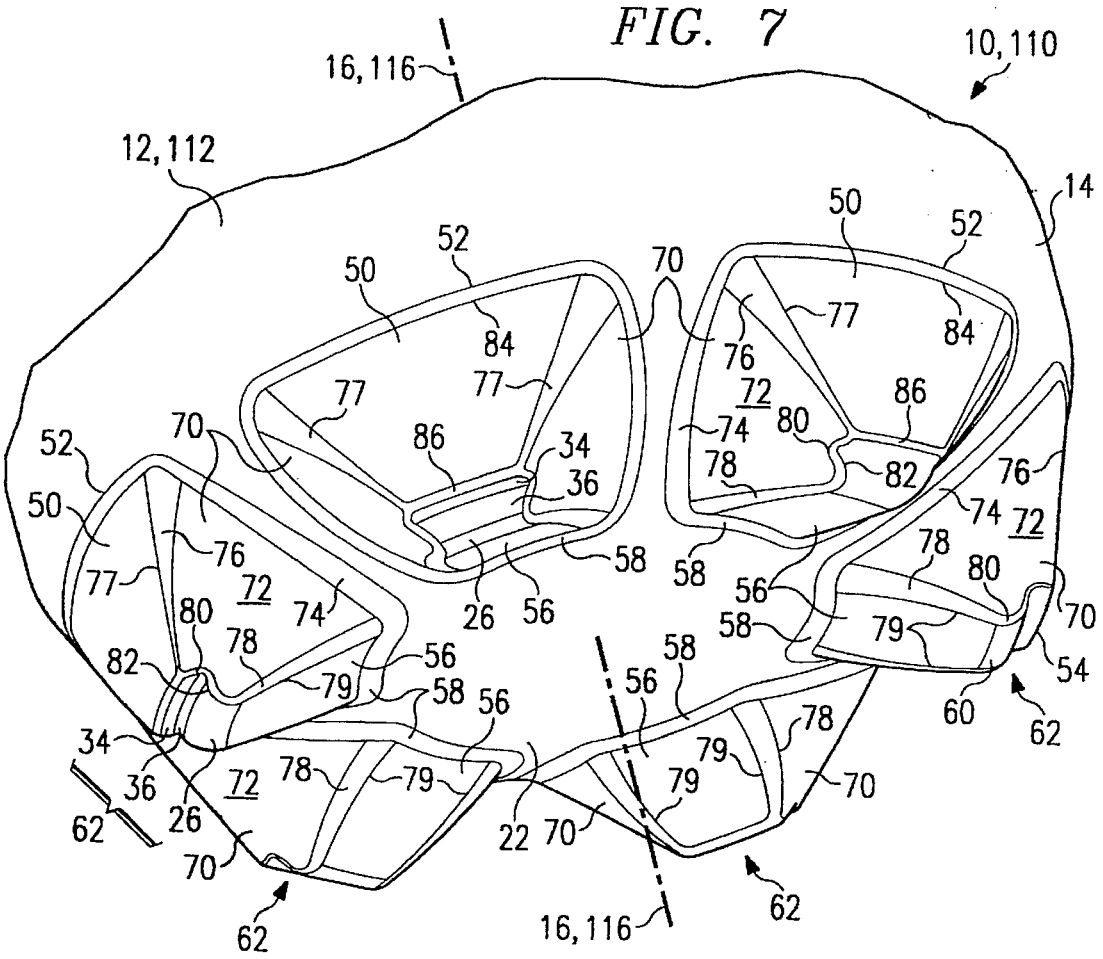
FIG. 7 is a partial perspective view of the lower side wall and bottom wall with supporting feet of the container of FIG. 1 or 10.
Figure 8:
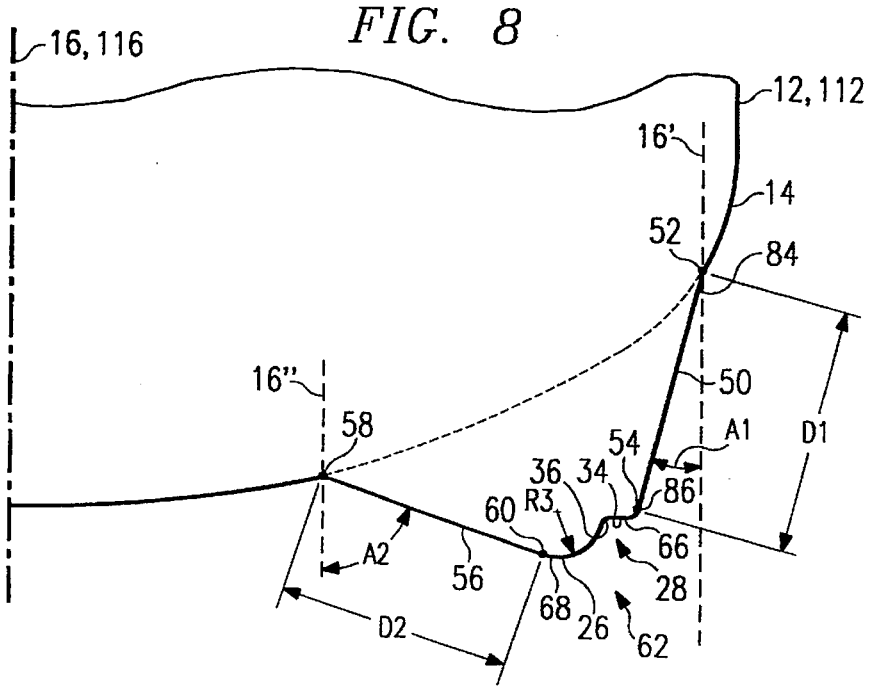
FIG. 8 is a partial cross-sectional elevation view, similar to FIG. 3, showing features of a supporting foot of the bottom wall of the container of FIG. 1 or 10.

Referring generally now to FIGS. 6, 7 and 8, additional features of supporting feet 24 of container 10 are described. Referring first to FIG. 7, in a preferred embodiment, each supporting foot 24 of container 10 is generally polyhedral in shape having exterior faces including a substantially flat trapezoidal outer face 50, a substantially flat inner face 56, a lower face 62 and two generally trapezoidal lateral faces 70. The trapezoidal shape of outer face 50 is shown in FIGS. 6 and 7. Referring now to FIG. 8, a partial cross-sectional elevation view through a supporting foot 24 is shown. FIG. 8 includes longitudinal axis 16 along with a first line 16' parallel to the longitudinal axis and a second line 16" also parallel to longitudinal axis 16. Outer face 50 depends from a first region 52 of bottom wall 14 generally inward at a first angle A1 in relation to longitudinal axis 16 (represented here by line 16') for a distance D1 to a second region 54 below the bottom wall. Inner face 56 depends from a third region 58 of bottom wall 14 generally outward at a second angle A2 in relation to longitudinal axis 16 (represented here by line 16") for a second distance D2 to a fourth region 60 below the bottom wall. Third region 58 is disposed radially inward in relation to first region 52 and fourth region 60 is disposed radially inward and axially downward in relation to second region 54. Still referring to FIG. 8, when viewed in cross-sectional elevation along a plane passing through longitudinal axis 16, lower face 62 defines a bi-curved, generally "S" shaped profile having an upper end 66 and a lower end 68. Upper end 66 is continuously joined to outer face 50 at second region 54 and lower end 68 is continuously joined to inner face 56 at fourth region 60. The upper portion of lower face 62, i.e., the externally concave portion nearest upper end 66, forms stacking features 28 comprising axial stacking surfaces 34 and lateral stacking surfaces 36. The lower portion of lower face 62, i.e., the externally convex portion nearest lower end 68, forms stand features 26. Those skilled in the art will appreciate that the profile of lower face 62 may comprise line segments of various radii and remain within the scope of the current invention as long as the face provides stand features 26 which alone provide stand stability for the container and stacking features 28 which alone provide stacking stability for the container when it is in stacking engagement with a below adjacent container when the container has internal pressure less than 70 psig. To provide satisfactory mobility, however, the radius of curvature R3 (best seen in FIG. 8) of stand features 26 should not be less than about 0.025". In a preferred embodiment, radius of curvature R3 of stand features 26 is within the range of about 0.05" to about 0.085'.

Referring now to FIG. 7, lateral faces 70 each have a substantially flat central region 72 surrounded by at least four locally curved edges 74, 76, 78 and 80. First locally curved edge 74 is continuously joined to bottom wall 14 between first region 52 and third region 58. Second locally curved edge 76 is continuously joined to a lateral edge 77 of outer face 50. Third locally curved edge 78 is continuously joined to a lateral edge 79 of inner face 56. Fourth locally curved edge 80 is continuously joined to a lateral edge 82 of lower face 62. Joined in this manner, the previously described faces 50, 56, 62 and 70 form a generally polyhedral supporting foot 24 resembling an inverted four-sided pyramid having a truncated apex with an externally concave groove. Although stacking features 28 may include some externally concave segments in their profiles, such elements have radii of curvature which are small relative to other radii in bottom wall 14, such as radius of curvature R2 of dome portion 22. The relatively small radii of segments in stacking features 28 result in relatively stiff mechanical features which better resist axial loads and operationally significant growth when the container is pressurized.

Referring again to FIG. 8, in a preferred embodiment of the current invention, outer face 50 depends from bottom wall 14 at a first angle A1 within the range of about 0° to about 45° in relation to longitudinal axis 16 and inner face 56 depends from bottom wall 14 at a second angle A2 within the range of about 30° to about 85° in relation to longitudinal axis 16. Such parameters may be suitable for use in a can having a main body diameter of about 2.6". In a more preferred embodiment, outer wall 50 depends from lower wall 14 at first angle A1 within the range of about 10° to about 21° in relation to longitudinal axis 16 and inner wall 56 depends from bottom wall 14 at a second angle A2 within the range of about 60° to about 79° in relation to longitudinal axis 16.

In yet another preferred embodiment of the current invention, the length of outer face 50 represented by distance D1 is within the range of about 0.37" to about 0.53" and the length of inner face 56 represented by second distance D2 within the range of about 0.30" to about 0.72". In a more preferred embodiment of the current invention, first distance D1 is within the range of about 0.42" to about 0.48" and second distance D2 is within the range of about 0.35" to about 0.48".

Referring now to FIG. 6, in a more preferred embodiment of the current invention, trapezoidal outer face 50 has an upper edge 84 adjacent to first region 52 of bottom wall 14 (not shown). Upper edge 84 has a first length W1 within the range of about 0.80" to about 0.90". Trapezoidal outer face 50 also has a lower edge 86 adjacent to second region 54 below bottom wall 14. In this embodiment, lower edge 86 has a second length W2 within the range of about 0.25" to about 0.32".

Figure 10:
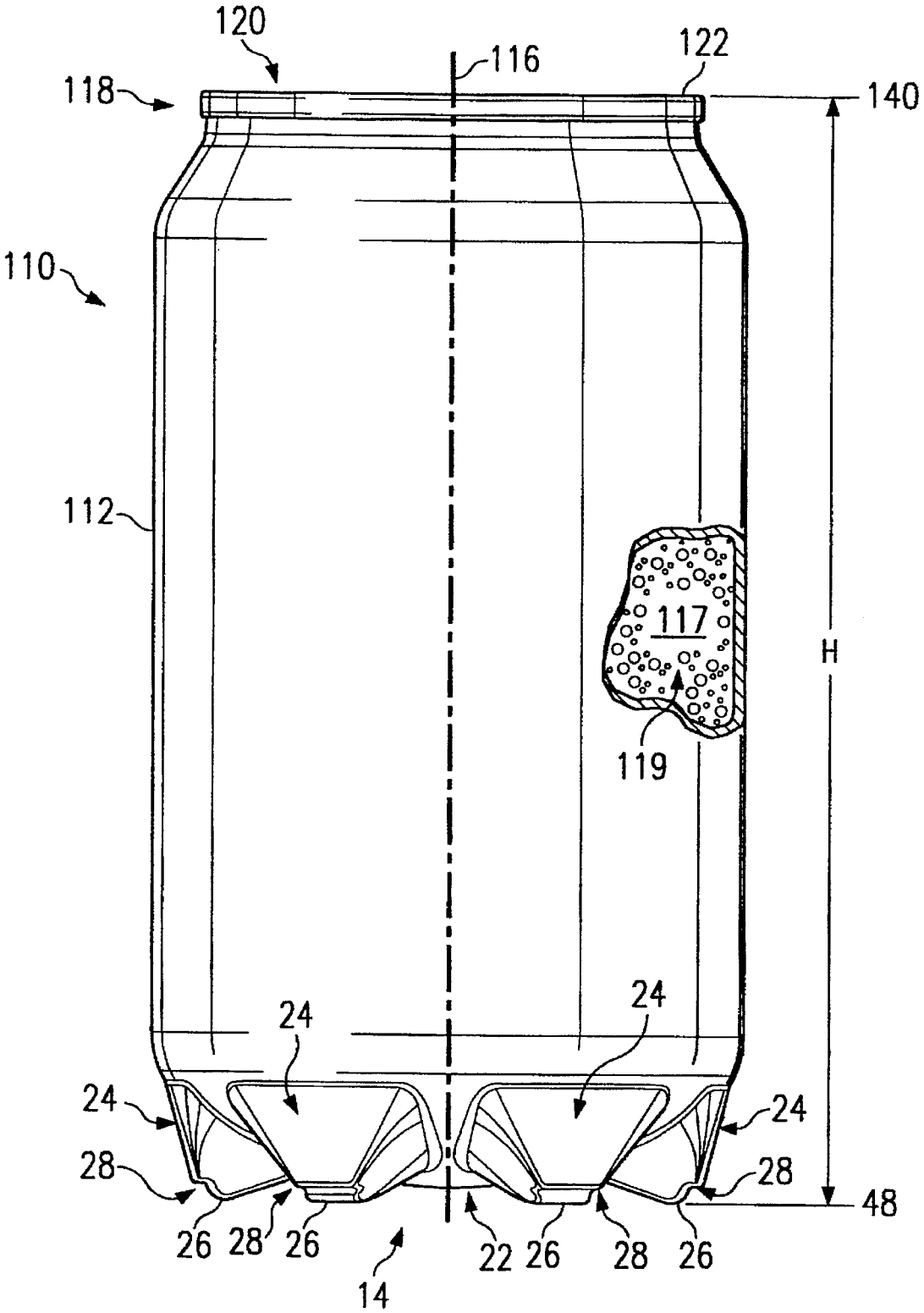
FIG. 10 is an elevation view of an alternative embodiment of the current invention with a portion cut-away to show the interior cavity; the wall thickness of the container shown in the cut-away portion is greatly exaggerated for purposes of illustration.

Referring now to FIG. 10, another embodiment of the current invention provides a container 110 for holding pressurized or pressure producing fluids. Container 110 comprises a generally cylindrical side wall 112, a bottom wall 14 having a plurality of supporting feet 24 and a lid 120. Side wall 112 is integrally formed with bottom wall 14, has a longitudinal axis 116 and extends substantially upward from bottom wall 14 to define an interior cavity 117 and an upper end 118 of the container which is adapted to be closed with lid 120. Note that the thickness of the side wall 112 shown in the cut-away portion of FIG. 10 has been exaggerated for illustration purposes. Lid 120 is seamed onto upper end 118 of container 110 after the introduction of a fluid 119 into interior cavity 117, thereby forming a rim 122 having a pressure tight seal which isolates interior cavity 117. Bottom wall 14 includes a externally convex, i.e., downwardly domed, dome portion 22 and a plurality of supporting feet 24 formed therein. The bottom of container 110 is similar in all significant respects to the bottom previously described for container 10 of FIG. 1, such that FIGS. 2–8 apply also to container 110. Thus, as shown in FIG. 2, supporting feet 24 of container 110 are circumferentially spaced apart from each other and project generally downward beyond dome portion 22. Each supporting foot has formed thereon stand features 26 and stacking features 28. Stand features 26 are radially spaced from longitudinal axis 116 and disposed at downward most locations on feet 24 so as to alone support container 110 in an upright position on a flat horizontal surface when container 110 is internally pressurized to less than about 70 psig. Referring now to FIGS. 3, 4 and 5, stacking features 28 are disposed adjacent to stand features 26 and defined in cross-sectional elevation view by axial stacking surfaces 34 and radial stacking surfaces 36. As best seen in FIG. 4, axial stacking surfaces 34 are axially positioned in relation to stand features 26 and radial stacking surfaces 36 are radially positioned in relation to longitudinal axis 116 so as to interfit with an upper seamed edge 38 of an adjacent below container 40 to alone support container 110 in stacking engagement when container 110 has an internal pressure of less than about 70 psig.

Referring to FIG. 3, to ensure that stand features 26 alone provide stand stability to container 110 under normal storage conditions, bottom wall 14 is constructed such that a first plane 44 formed perpendicular to longitudinal axis 116 and tangent to downward most point 46 on dome portion 22 of bottom wall 14 is located axially above a second plane 48 formed perpendicular to longitudinal axis 116 and passing through axial stacking surfaces 34 when container 110 has an internal pressure of less than about 70 psig.

In addition, the structure of bottom wall 14 provides for a container which resists axial loads and undesired deformations when internally pressurized.

Figure 9A:
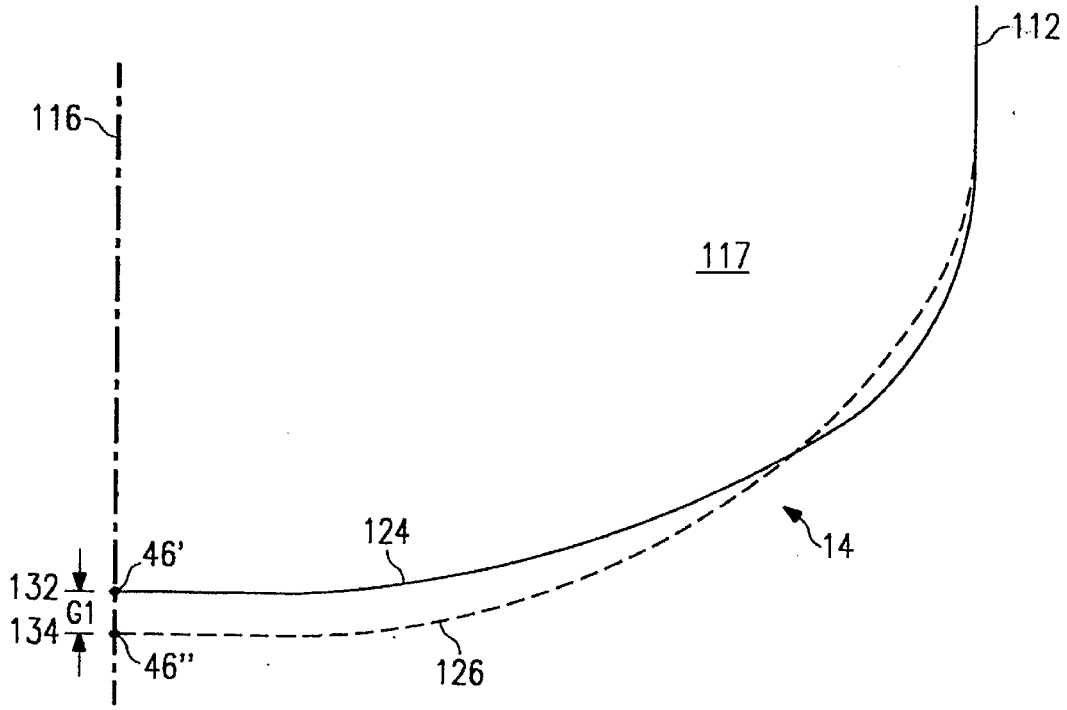
FIG. 9*a* shows a comparison of bottom wall profiles taken along line 5—5 of FIG. 2, one profile for an unpressurized container and one profile of a container which is internally pressurized.
Figure 9B:
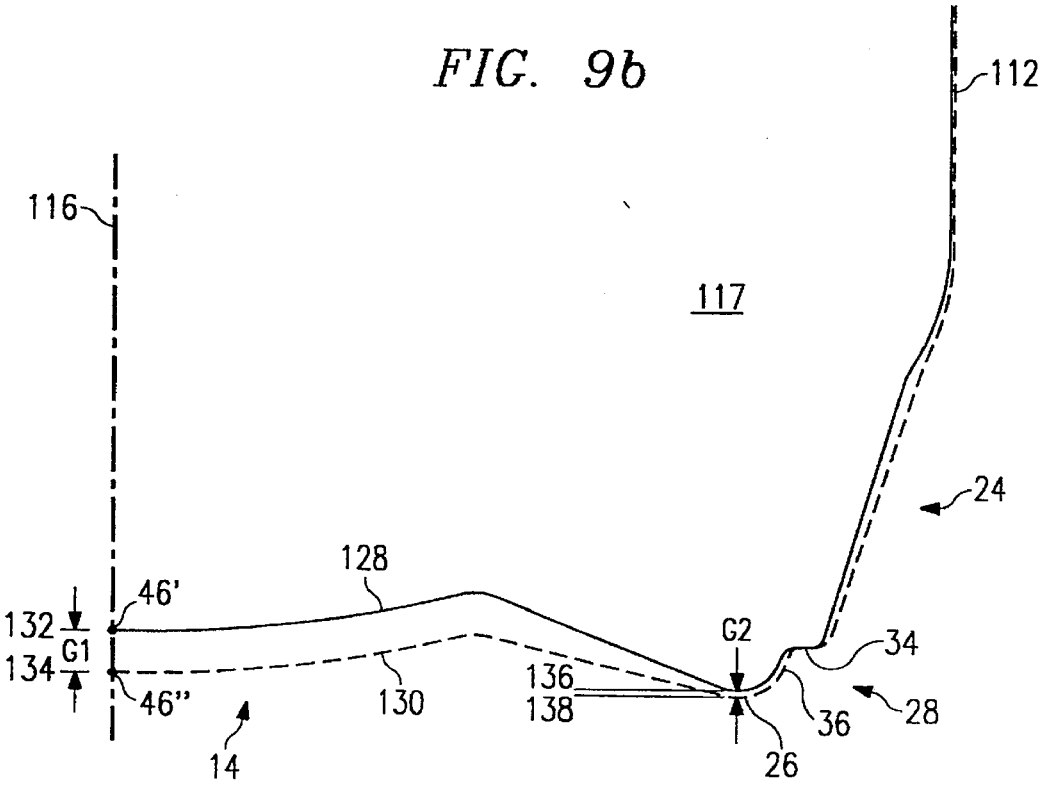
FIG. 9*b* shows a comparison of wall profiles taken along line 3—3 of FIG. 2, one profile for an unpressurized container and one profile for a container which is internally pressurized.

Referring now to FIGS. 9*a* and 9*b*, sets of partial cross-sectional elevation views of the lower portion of container 110 are provided illustrating differences in the container's bottom profile for conditions when container 110 is not internally pressurized and for conditions when container 110 is internally pressurized to an extremely high internal pressure of about 120 psig. FIG. 9*a* provides a comparison of bottom profiles taken along line 5—5 of FIG. 2, i.e., between circumferentially adjacent supporting feet 24. FIG. 9*b* provides a comparison of bottom profiles taken along line 3—3 of FIG. 2, i.e., through a supporting foot 24.

Thus, in FIG. 9*a*, first bottom profile 124 is the profile of can bottom 14 when container 110 is not subject to internal pressurization and second bottom profile 126 (shown in phantom) is the profile of bottom wall 14 when internal cavity 117 is pressurized to a pressure of about 120 psig. Similarly, in FIG. 9*b*, third bottom profile 128 is the profile of bottom wall 14 passing through supporting foot 24 when container 110 has an internal pressure of 0 psig and fourth bottom profile 130 (shown in phantom) is the profile of bottom wall 14 passing through supporting foot 24 when container 110 has internal cavity 117 pressurized to about 120 psig. Still referring to FIGS. 9*a* and 9*b*, when container 110 is internally pressurized to 0 psig, a lowest point 46 (shown as 46') of bottom wall 14 occupies a first axial position 132 relative to a highest point (not shown) on the rim of the lid. When container 110 is internally pressurized to 120 psig, lowest point 46 (now shown as 46") occupies a second axial position 134 relative to the highest point on the rim of the lid. In a preferred embodiment, axial distance G1 between first axial position 132 and second axial position 134 is within the range of about 0.050" to about 0.070".

Referring now only to FIG. 9*b*, when container 110 is internally pressurized to 0 psig, stand features 26 on supporting feet 24 occupies a third axial position 136 relative to a highest point on the rim of the lid. When container 110 is internally pressurized to about 120 psig, stand features 26 occupies a fourth axial position 138 relative to said highest point on the rim of the lid. In another preferred embodiment of the current invention, the axial distance G2 between third position 136 and fourth axial position 138 is within the range of about 0.01" to about 0.02".

Referring again to FIG. 10, in yet another embodiment of the current invention, container 110 has an overall height H measured axially from a first plane 140 formed perpendicular to longitudinal axis 116 and passing through an upwardmost point of rim 122 to a second plane 48 formed perpendicular to longitudinal axis 116 and passing through stand features 26. In a preferred embodiment of the current invention, a difference between a first value of overall height H for container 110 when interior cavity 117 is pressurized to 0 psig and a second value of overall height H for container 110 when interior cavity 117 is pressurized to 100 psig is within the range of about 0.01" to about 0.04".

Figure 11:
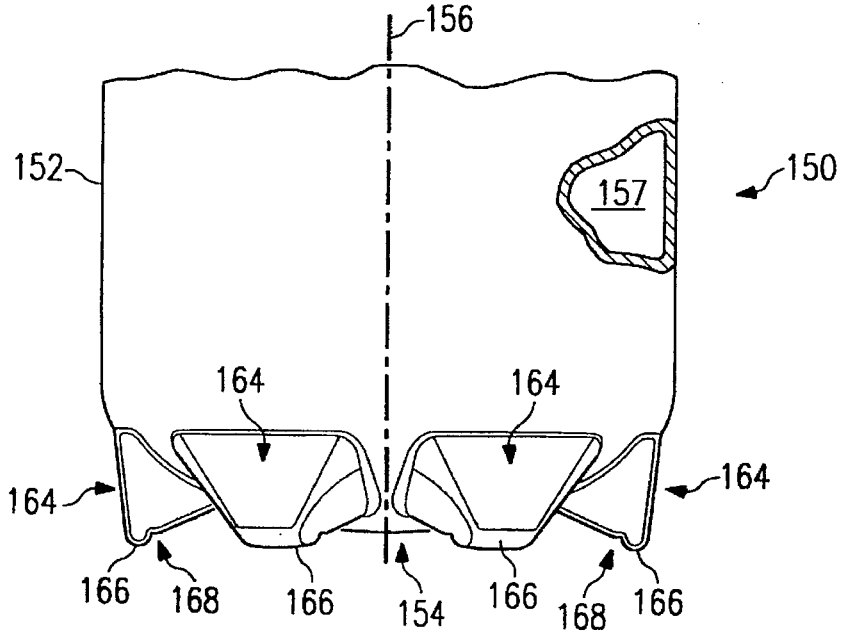
FIG. 11 is a partial elevation view of the lower portion of a container constructed in accordance with yet another embodiment of the current invention with a partial cut-away to show the interior cavity; the wall thickness of the container shown in the cut-away portion is greatly exaggerated for purposes of illustration.
Figure 12:
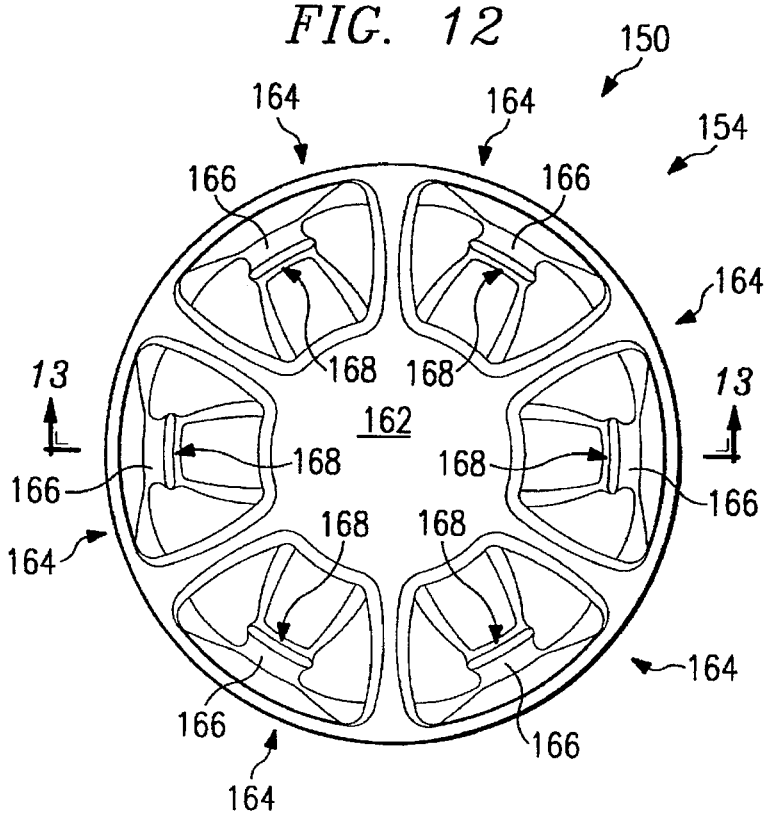
FIG. 12 is a bottom plan view showing the bottom wall and supporting feet of the container of FIG. 11.

Referring generally to FIGS. 11–14, the lower portion of a metal container 150 in accordance with another embodiment of the current invention is shown. Referring now to FIG. 11, container 150 has the same general layout as containers 10 and 110 of previous embodiments, including a generally cylindrical side wall 152 and a bottom wall 154 formed integrally with the side wall. Side wall 152 has a longitudinal axis 156 and extends upward from bottom wall 154 to define an interior cavity 157 and an open end (not shown) which may be sealed with a lid as in the previously discussed embodiments. Also note that, as in FIGS. 1 and 10, the thickness of side wall 152 show in the cut-away portion of FIG. 11 has been exaggerated for purposes of illustration. Bottom wall 154 includes a externally convex domed portion 162 and a plurality of supporting feet 164 formed thereon.

Supporting feet 164 are circumferentially spaced apart and project generally downward beyond dome portion 162. As in the previously discussed embodiments, supporting feet 164 have formed thereon stand features 166 and stacking features 168, which alone provide stand stability and stacking stability, respectively, when the container is internally pressurized to less than about 70 psig. However, in this embodiment, unlike the previous embodiments, stand features 166 are disposed radially outward relative to stacking features 168.

Figure 13:
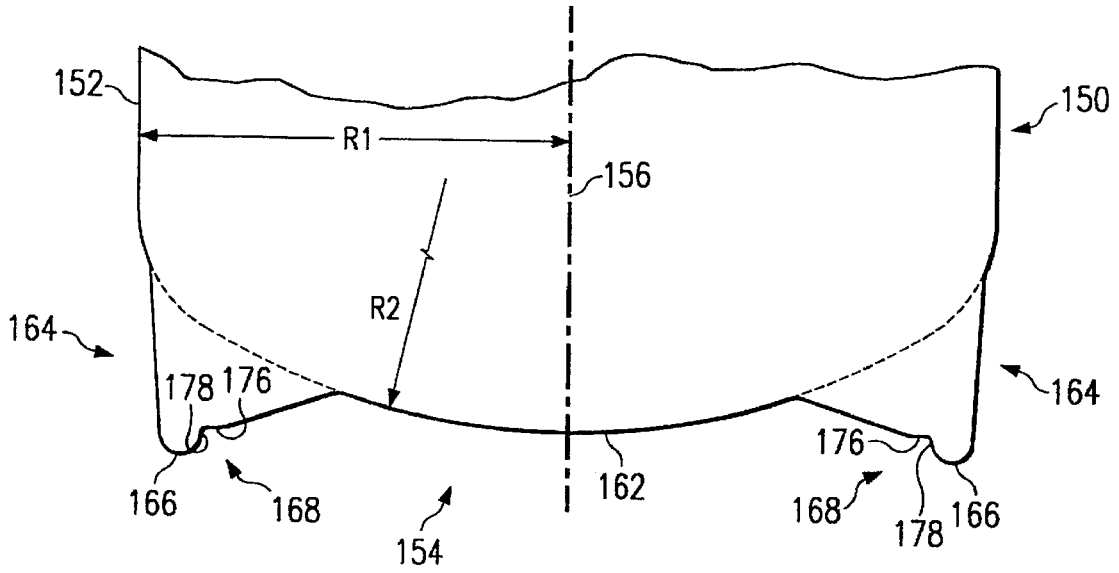
FIG. 13 is a partial cross-sectional elevation view of the lower portion of the container taken along the line 13—13 of FIG. 12.
Figure 14:
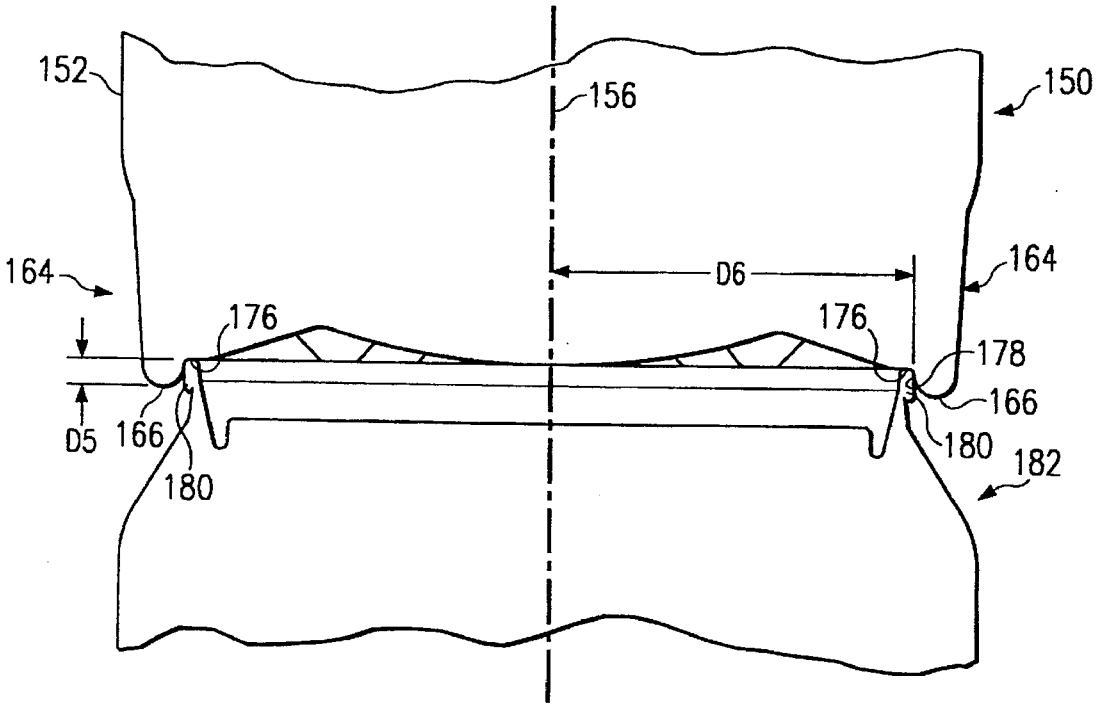
FIG. 14 is another partial cross-sectional elevation view, similar to FIG. 13, but depicting the bottom wall of the container of FIG. 11 in stacked relationship with an adjacent below container.

As best seen in FIGS. 13 and 14, stand features 166 are disposed on downwardmost locations on feet 164 and stacking features 168 are disposed on radially inward-oriented locations adjacent to stand features 166. Stacking features 168 are defined, in cross-sectional elevation view, by an axial stacking surface 176 and a lateral stacking surface 178. Referring now to FIG. 14, it can be seen that axial stacking surfaces 176 are positioned axially upward a distance of D5 in relation to stand features 166 and lateral stacking surfaces 178 are positioned radially outward a distance D6 in relation to longitudinal axis 156 so as to interfit with an upper seamed rim 180 of an adjacent below container 182 to support container 150 in stacking engagement. Additional details of container 150 are similar to those of the previously discussed embodiments except for variations necessitated by the transposition of stand features 166 and stacking features 168, such necessary variations being understood upon examination of FIGS. 11–14.

While presently preferred embodiments of the invention have been illustrated and described, it will be understood that the invention is not limited thereto, but may be otherwise variously embodied within the scope of the following claims.

We claim:

1. A metal container, comprising:

a generally cylindrical side wall and a bottom wall formed integrally with said side wall from a single sheet of metal;

said side wall having a longitudinal axis and extending substantially axially upward from said bottom wall to define an interior cavity and an open end of the container adapted to be closed with a lid seamed onto said open end;

said bottom wall including a externally convex dome portion and a plurality of discrete supporting feet formed therein, said feet being circumferentially spaced apart from each other and projecting generally downward beyond said dome portion in the absence of internal pressure in the interior cavity;

each said foot having formed thereon stand features and stacking features;

said stand features radially spaced from said longitudinal axis and disposed at downwardmost locations on said feet and alone supporting the container in an upright position on a flat horizontal surface in the absence of internal pressure in the interior cavity;

said stacking features disposed adjacent to said stand features and defining, in cross-section elevation view, axial stacking surfaces and lateral stacking surfaces; and said axial stacking surfaces being axially positioned in relation to said stand features and said lateral stacking surfaces being radially positioned in relation to said longitudinal axis to interfit with an upper seamed edge of an adjacent below container whereby said stacking features alone support the container in stacking engagement in the absence of internal pressure in the interior cavity.

2. The metal container of claim 1, wherein said side wall has a side wall radius R1 with a value V1 and said domed portion is defined, in cross-sectional elevation view through a region of said domed portion between said feet, by a radius of curvature R2 with a value V2 in the range of about 1.6 to about 2.2 times the value V1 of side wall radius R1.

3. The metal container of claim 2, wherein said domed portion is defined, in cross-sectional elevation view through a region of said domed portion between said feet, by a radius of curvature R2 with a value V2 in the range of about 1.72 to about 1.88 times the value V1 of side wall radius R1.

4. The metal container of claim 1, wherein said domed portion is defined, in cross-sectional elevation view through a region of said domed portion between said feet, by a radius of curvature R2 with a value V2 in the range of about 2.08 inches to about 2.86 inches.

5. The metal container of claim 4, wherein said domed portion is defined, in cross-sectional elevation view through a region of said domed portion between said feet, by a radius of curvature R2 with a value V2 in the range of about 2.24 inches to about 2.44 inches.

6. The metal container of claim 1, wherein said stand features are defined, in cross-sectional elevation view, by a radius of curvature R3 with a value not less than about 0.025 inch.

7. The metal container of claim 6, wherein said stand features are defined, by a radius of curvature R3 having a value within the range of about 0.05 inch to about 0.085 inch.

8. The metal container of claim 1, wherein the maximum thickness of the bottom wall is less than about 0.010 inches.

9. The metal container of claim 1, wherein said stand features are disposed radially inward relative to said stacking features.

10. The metal container of claim 9, wherein each said supporting foot is generally polyhedral in shape having exterior faces including:

a substantially flat trapezoidal outer face depending from a first region of said bottom wall generally inwards at a first angle A1 in relation to said longitudinal axis a first distance D1 to a second region below said bottom wall;

a substantially flat inner face depending from a third region of said bottom wall generally outward at a second angle A2 in relation to said longitudinal axis a second distance D2 to a fourth region below said bottom wall, said third region being disposed radially inward in relation to said first region, and said fourth region being disposed radially inward and axially downward in relation to said second region;

a lower face defining, when viewed in cross-sectional elevation along a plane passing through the longitudinal axis, a generally "S" shaped profile having an upper end and a lower end, said upper end continuously joined to said outer face at said second region and said lower end continuously joined to said inner face at said fourth region so as to form said stand features and said stacking features; and two generally trapezoidal lateral faces, each said lateral face having a substantially flat central region surrounded by at least four locally curved edges and having a first said locally curved edge continuously joined to said bottom wall between said first region and said third region, a second said locally curved edge continuously joined to an edge of said outer face, a third said locally curved edge continuously joined to an edge of said inner face, and a fourth said locally curved edge continuously joined to an edge of said lower face.

11. The metal container of claim 10, wherein said first angle A1 is within the range of about 0° to about 45° in relation to said longitudinal axis and said second angle A2 is within the range of about 30° to about 85° in relation to said longitudinal axis.

12. The metal container of claim 11, wherein said first angle A1 is within the range of about 10° to about 21° in relation to said longitudinal axis and said second angle A2 is within the range of about 60° to about 79° in relation to said longitudinal axis.

13. The metal container of claim 10, wherein said first distance D1 is within the range of about 0.37 inches to about 0.53 inches and said second distance D2 is within the range of about 0.30 inches to about 0.72 inches.

14. The metal container of claim 13, wherein said first distance D1 is within the range of about 0.42 inches to about 0.48 inches and said second distance D2 is within the range of about 0.35 inches to about 0.48 inches.

15. The metal container of claim 14, wherein said trapezoidal outer face has an upper edge adjacent to said first region of said bottom wall, said upper edge having a first length W1 within the range of about 0.80 inches to about 0.90 inches, and a lower edge adjacent to said second region below said bottom wall, said lower edge having a second length W2 within the range of about 0.25 inches to about 0.32 inches.

16. The metal container of claim 1, wherein said stand features are disposed radially outward relative to said stacking features.

17. A metallic container for holding pressurized or pressure-producing fluids, said container comprising:

a generally cylindrical side wall, a bottom wall having a plurality of supporting feet, and a lid;

said side wall integrally formed with said bottom wall, having a longitudinal axis, and extending substantially upward from said bottom wall to define an interior cavity and an open end of the container, said open end adapted to be closed with said lid;

said lid seamed onto said open end of the container after the introduction of a fluid into said interior cavity, thereby forming a rim having a pressure-tight seal which isolates the interior cavity;

said bottom wall including a externally convex dome portion and a plurality of supporting feet formed therein, said feet being circumferentially spaced apart from each other and projecting generally downward beyond said dome portion when said container has an internal pressure less than 70 psig;

each said foot having formed thereon stand features and stacking features;

said stand features radially spaced from said longitudinal axis and disposed at downwardmost locations on said feet to alone support the container in an upright position on a flat horizontal surface when said container has an internal pressure less than about 70 psig;

said stacking features disposed adjacent to said stand features and defining, in cross-section elevation view, axial stacking surfaces and lateral stacking surfaces; and said axial stacking surfaces being axially positioned in relation to said stand features and said lateral stacking surfaces being radially positioned in relation to said longitudinal axis to interfit with an upper seamed edge of an adjacent below container whereby said stacking features alone support said container in stacking engagement when said container has an internal pressure of less than about 70 psig.

18. The metal container of claim 17, wherein a first plane formed perpendicular to said longitudinal axis and tangent to a downward most point on the dome portion of the bottom wall is located axially above a second plane formed perpendicular to the longitudinal axis and passing through the axial stacking surfaces when said container has an internal pressure of less than about 70 psig.

19. The metal container of claim 17, wherein a lowest point on said dome portion occupies a first axial position relative to a highest point on said rim of said lid when said container is internally pressurized to 0 psig and occupies a second axial position relative to said highest point on said rim of said lid when said container is internally pressurized to 100 psig, and wherein the axial distance G1 between said first axial position and said second axial position is within the range of about 0.05 inches to about 0.07 inches.

20. The metal container of claim 17, wherein said stand features on said supporting feet occupy a third axial position relative to a highest point on said rim of said lid when said container is internally pressurized to 0 psig and occupy a fourth axial position relative to said highest point on said rim of said lid when said container is internally pressurized to 100 psig, and wherein the axial distance G2 between said third axial position and said fourth axial position is within the range of about 0.01 inches to about 0.02 inches.

21. The container of claim 17, wherein said container has an overall height H measured axially from a first plane formed perpendicular to said longitudinal axis and passing through an upward most portion of said rim to a second plane formed perpendicular to said longitudinal axis and passing through said first support features, and wherein a difference between a first value of overall height H for said container when said interior cavity is internally pressurized to 0 psig and a second value of overall height H for said container when said interior cavity is internally pressurized to 70 psig is within the range of about 0" to about 0.04".

* * * * *